US005365686A

United States Patent [19]

Scott

[11] Patent Number: 5,365,686

[45] Date of Patent: Nov. 22, 1994

[54] PICTURE HOLDER WITH A RECORDER/PLAYBACK INTEGRATED CIRCUIT

[76] Inventor: James G. Scott, P.O. Box 626, Lutz, Fla. 33549

[21] Appl. No.: 901,014

[22] Filed: Dec. 29, 1992

[51] Int. Cl.[5] ..... G09F 27/00

[52] U.S. Cl. ..... 40/455; 40/152

[58] Field of Search ..... 40/124.1, 152, 455, 40/661; 369/63, 64, 69, 70

[56] References Cited

U.S. PATENT DOCUMENTS

| | | | |
|---|---|---|---|
| 3,691,312 | 9/1972 | Petersen | 40/455 X |
| 3,857,191 | 12/1974 | Sadorus | 40/455 |
| 4,541,188 | 9/1985 | Sadorus | 40/152.1 |
| 4,648,086 | 3/1987 | Koike | 369/63 X |
| 4,745,695 | 5/1988 | Hetzer | 40/661 |
| 4,791,741 | 12/1988 | Kondo | 369/64 X |
| 4,934,079 | 6/1990 | Hoshi | 40/465 X |
| 5,063,698 | 11/1991 | Johnson et al. | 40/124.1 |

*Primary Examiner*—Brian K. Green
*Attorney, Agent, or Firm*—John B. Dickman, III

[57] ABSTRACT

A display device and recorder/playback system combination including a panel for displaying photographs, posters, etc. and having an integrated circuit memory chip embedded therein, and a recorder/playback system that connects to the integrated circuit memory chip. The embedded integrated circuit memory chip is disconnectable from the recorder/playback system whereby different display panels with different messages can be connected to the recorder/playback system and the messages stored in the memory chips are not destroyed by being disconnected from a power source.

9 Claims, 3 Drawing Sheets

PICTURE HOLDER WITH A RECORDER/PLAYBACK INTEGRATED CIRCUIT

BACKGROUND OF THE INVENTION

The present invention relates to a picture holder with an electronic sound recording that embodies either a prerecorded or personalized message.

There are many instances where an audio message describing a picture, a poster, a menu, or a personal message associated with a picture are a benefit. A problem associated with the prior art devices combining audio and visual components is that the photograph and the recorded message become separated, or that the electronic sound recording electronics, including the recorded message chip, can not be separated from the photograph and frame.

Prior art U.S. Pat. No. 4,934,079 discloses a display panel and a recorder/playback combination. In its simplest description the recorder/playback combination is connected to a speaker, a power source and a switch, where the entire electronic package is mounted on a display panel. An integral circuit memory chip stores sound or music, and the power source is a lightweight cell.

Another picture and audio assembly is disclosed in U.S. Pat. No. 4,541,188, where a picture mounted in a frame and rests in a support on the housing of an electronic audio machine. The audio machine is a tape cassette playback assembly. All of the audio equipment is contained in the housing, therefore, there is no connection between the picture and the audio assembly, such that if the photograph is changed there may not be a relationship to the recorded message.

U.S. Pat. No. 4,856,213, discloses a picture frame with a holder for a video cassette.

The primary purpose of the present invention is to provide a picture holder with a recorder/playback integrated circuit which remains with the holder, even if the holder is separated from the power source, speakers and associated electronics.

SUMMARY OF THE INVENTION

According to the display devices with recorder/playback means of the present invention, an "on-off" switch or a sensor sensitive to light, sound or heat and a recorder/playback combination are mounted on the back side of a display device. The display device can be a U-shaped panel which houses a photograph between the U. The recorder/playback combination is mounted on the panel side on the back of the photograph. Since the U-shaped panel can be mounted in a picture frame the recorder/playback combination is either permanently mounted to the back of the panel, or it is removable except for an integrated circuit chip which remains with the display device.

In another embodiment the display device connects in an electronic shoe of a recorder/playback combination assembly. An integrated circuit memory-chip with a recorded message is embedded in a panel of the device wherein when the display device connects with the recorder/playback combination the recorded message is playable. However, the integrated circuit chip remains with the display device.

DESCRIPTION OF THE INVENTION

Figure 1:
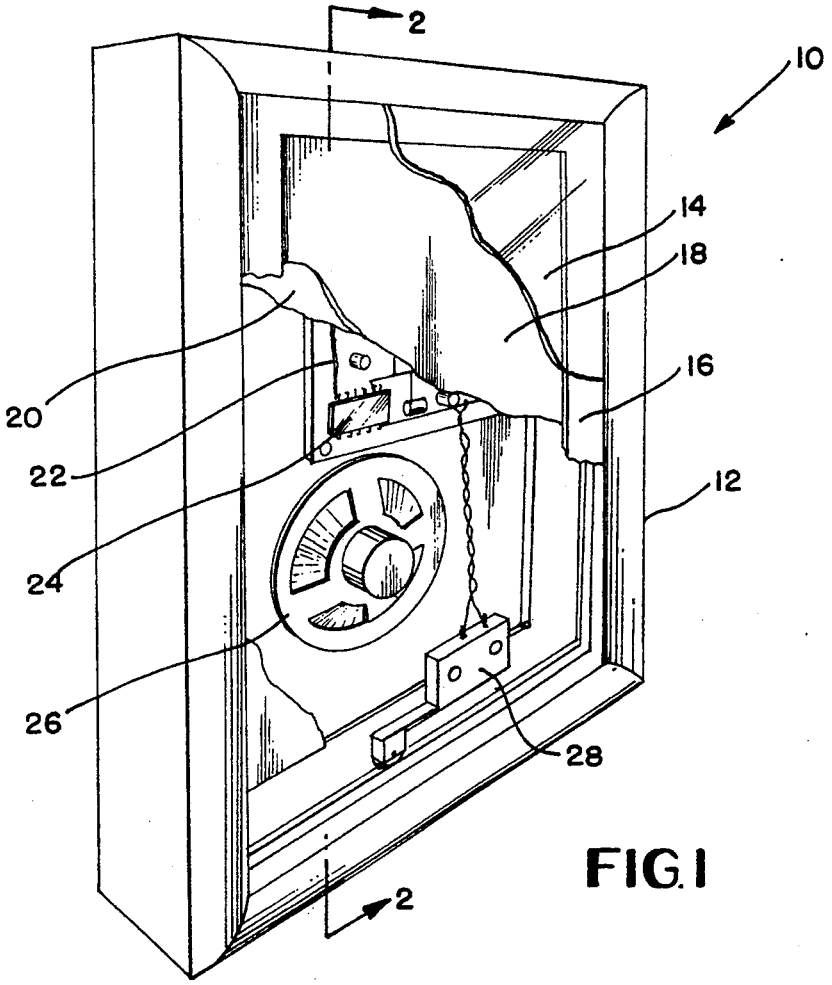
FIG. 1 is an isometric view of a display device and recorder/playback combination of the invention.
Figure 2:
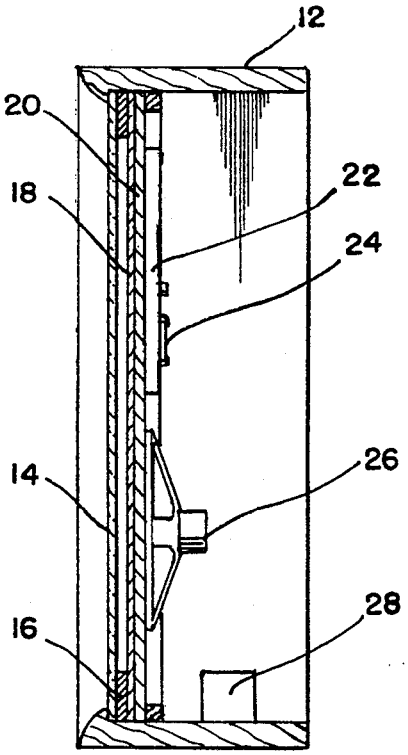
FIG 2. is a cross sectional view of the invention taken along the line 2—2 of FIG. 1.

Referring to the drawings and in particular to FIGS. 1 and 2, there is shown a display device and recorder/playback combination 10. A picture frame 12 having a rectangular shape and a greater width than normal is used to hold a picture and audio equipment. A clear protective cover of glass or plastic 14 and a decorative edging matt 16 are mounted on the face of picture frame 12. A photograph 18 is mounted behind protective cover 14, facing the front of the frame. Behind photograph 18 backing panel 20 to hold the photo in place. Mounted on the backing panel 20 is a circuit board 22 which contains all of the electronics for a recorder/playback combination, including an integrated circuit, I. C. chip 24. The circuit board 22 or the I. C. chip 24 alone is permanently bonded to the backing panel 20.

Wired to the circuit board 22 is a speaker 26 and an "off-on" switch 28. The switch 28 is either a manual switch, or a sensor type which will detect light, heat or motion.

Integrated circuit chip 24 is an analog memory chip which receives and stores messages for playback. An electrical input, representative of a personalized message is fed to integrated circuit chip 24 which is based on (EEPROM) technology which may be external or integrated on circuit board 22. Integrated circuit chip 24 is of the type that allows a new message to be recorded thereby erasing or replacing the old one. Chip 24 is also of the new generation of integrated circuit chips which holds a message for at least ten years even if electrical power is removed. The chip is non-volatile.

The power source, not shown, is either a d. c. battery mounted in the picture frame 12, or an external power source including a d. c. battery or a. c. current.

In use, switch 28 senses light, heat or motion to activate the electronics of circuit board 22 operating the recorder/playback combination.

Figure 3:
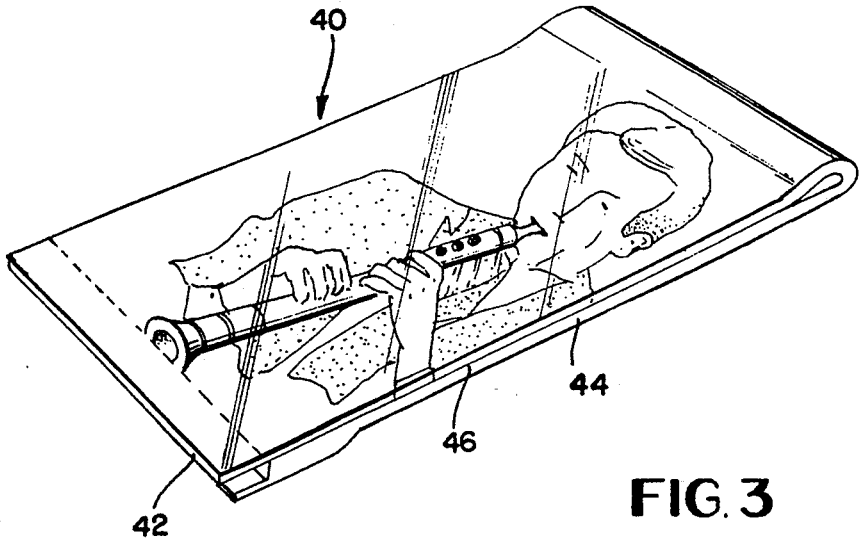
FIG. 3 is an isometric view of a picture holder of the invention.
Figure 4:
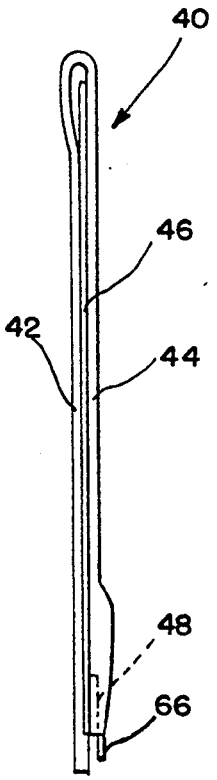
FIG. 4 is a side view of a picture holder of FIG. 3.
Figure 5:
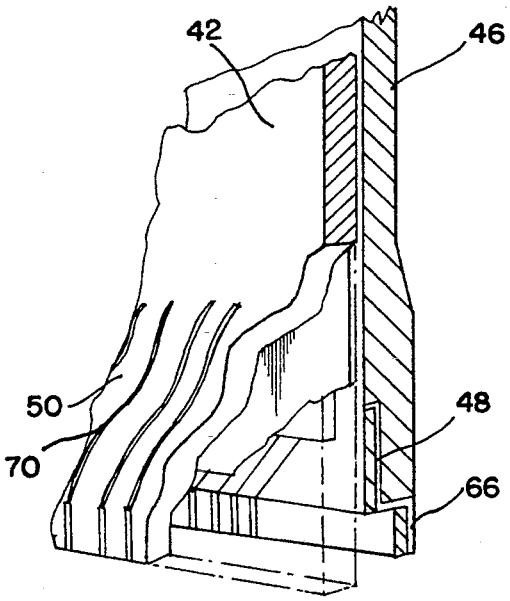
FIG. 5 is a partial cross section view of another embodiment of a picture holder of the invention.
Figure 6:
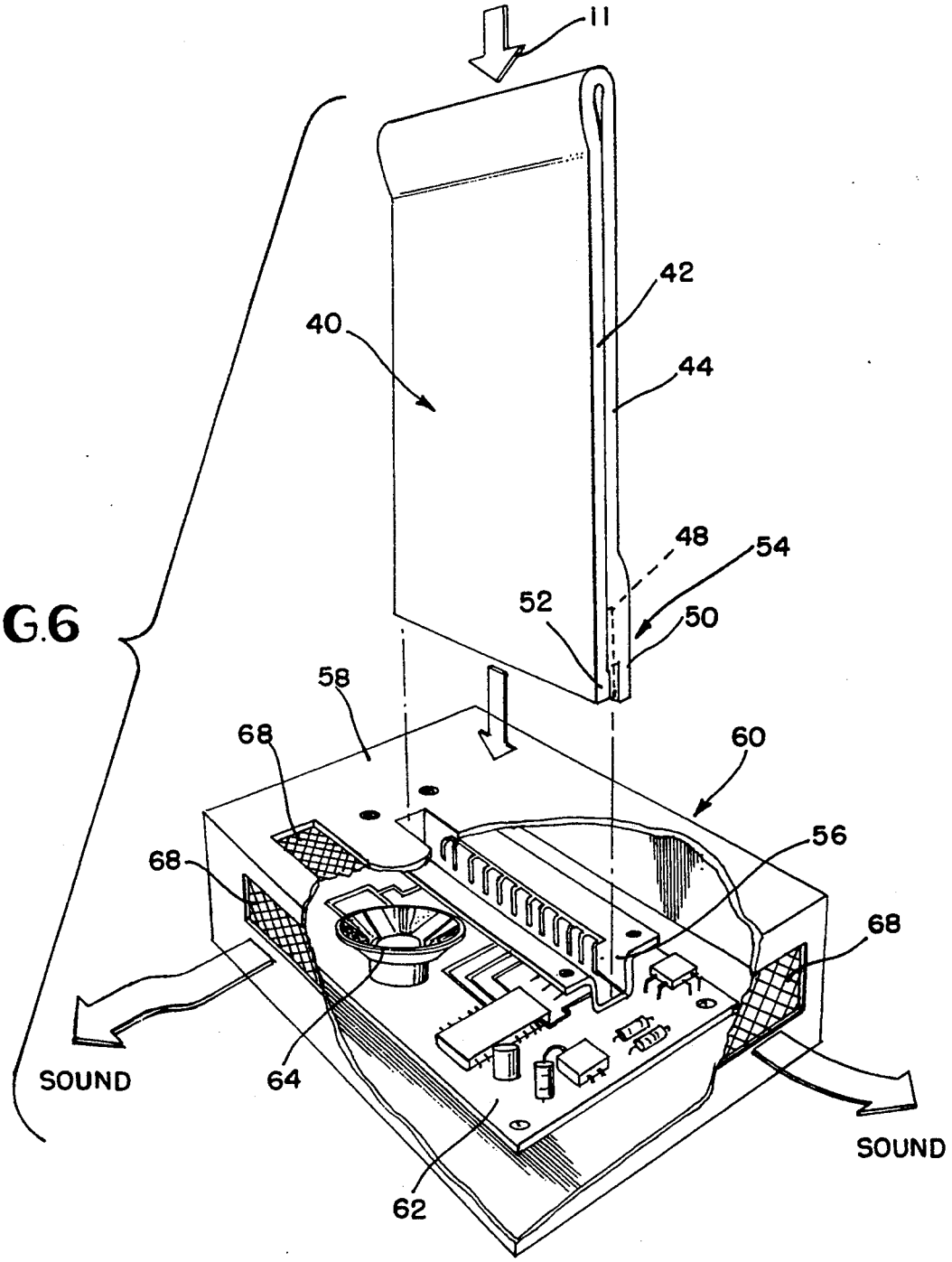
FIG. 6 is an isometric view showing a picture holder in position for assembly with a recorder/playback combination.

Turning to the embodiment of FIGS. 3–6, there is shown in FIG. 6 a U-shaped display device which forms a front panel 42 and a rear panel 44. Housed between panels 42 and 44 is a photograph 46 (FIG. 3). An I. C. memory chip 48 is embedded in rear panel 44 at the lower end where the legs or panels of the U-shaped display device 40 are not connected. The unconnected ends 50 and 52 form a male connector 54 which connects to an electronic female connector 56 on a housing 58.

A recorder/playback combination electronic device 60 including a circuit board 62, a speaker 64 and a power source (or a connector to a power source), not shown, is mounted in housing 58. Female connector 56 is electronically connected to a circuit board 62 to provide an electrical connector for I. C. memory chip 48 embedded in display device 40. I. C. memory chip 48 has a plurality of electrical leads 66 which are exposed for contacting female connector 56 to complete a circuit. In FIGS. 4 and 6 the I. C. memory chip 48 is shown in dashed lines.

The housing 60 has sound openings 68 on the top and sides to emit sound from speaker 64. In FIG. 5, alternative sound openings 70 are provided on unconnected end 50 of front panel 42. If openings 70 are used to emit sounds, openings 68 in the housing are not used.

In use of the embodiment of FIGS. 3–6, the display device 40 is plugged into housing 60. Male connector 54 connects to female connector 56 completing a circuit between I. C. memory chip 48 and circuit board 62. Circuit board 62 contains the well known components for receiving the analog message from chip 48 and producing a sound loud enough to be heard. There is a switching device (not shown) which is either manually operated or light, heat or motion sensed and operated.

The essence of the invention is that I. C. memory chip 48 remains with the display device even if the circuit board, speaker and power source is removed, therefore, the memory chip 48 has to be of the generation of I. C. chips which stores messages without a power source for periods up to 10 years (non-volatile).

I claim:

1. A display device and recorder/playback system combination, comprising:

a plurality of display panels for displaying a photograph or some other display;

a recorder/playback system including electronic means to play a recorded message;

an integrated circuit memory chip embedded in each of said plurality of display panels to connect to said recorder/playback system, where said integrated circuit memory chip stores recorded messages and is capable of receiving a recorded message in place of an original message; and means for allowing said plurality of display panels to be disconnectable from said recorder/playback system.

2. A display device and recorder/playback system as in claim 1 wherein each of said display panels a U-shaped member having a first panel and a second panel connected at one end and having free-ends wherein a photograph is inserted between said first and second panels, and one of said integrated circuit memory chips is embedded in one of said free-ends of one of said panels, said free-ends are a male connector to connect to said recorder/playback system having a female connector.

3. A display device and recorder/playback system as in claim 2 wherein said recorder/playback system is mounted in a housing.

4. A display device and recorder/playback system as in claim 3 wherein said display device has openings to emit sound from said recorder/playback system.

5. A display device and recorder/playback system as in claim 4 wherein said integrated circuit memory chip has a plurality of exposed electrical contacts for connecting to said recorder/playback system.

6. A display device and recorder/playback system combination comprising:

a display panel means for displaying a photograph or some other display;

a recorder/playback system including electronic means to play a recorded message;

an integrated circuit memory chip embedded in said display panel means to connect to said recorder/playback system, where said integrated circuit memory chip stores recorded messages and is capable of receiving a recorded message in place of an original message;

where said display panel means is disconnectable from said recorder/playback system; and wherein said display panel means is a U-shaped member having a first panel and a second panel connected at one end and having free-ends whereby a photograph is inserted between said first and second panels, and an integrated circuit memory chip is embedded in one of said free ends of said panels, said free-ends having male connector means to connect to said recorder/playback system having female connector means.

7. A display device and recorder/playback system as in claim 6 wherein said recorder/playback system is mounted in a housing.

8. A display device and recorder/playback system as in claim 7 wherein said display device has openings to emit sound from said recorder/playback system.

9. A display device and recorder/playback system as in claim 8 wherein said integrated circuit memory chip has a plurality of exposed electrical contact for connecting to said recorder/playback system.

* * * * *